US006096985A

United States Patent [19]

Ritter et al.

[11] Patent Number: 6,096,985

[45] Date of Patent: Aug. 1, 2000

[54] BUTTON ASSEMBLY

[75] Inventors: Darin Bradley Ritter; Michel Alain Cadio; William Hofmann Bose, all of Indianapolis, Ind.

[73] Assignee: Thomson Licensing S.A., France

[21] Appl. No.: 09/374,368

[22] Filed: Aug. 13, 1999

[51] Int. Cl.[7] ..... H01H 25/04

[52] U.S. Cl. ..... 200/6 A; 200/5 R

[58] Field of Search ..... 200/4, 5 R, 6 R, 200/6 A, 17 R, 18, 332, 335, 339; 400/479; 273/148 B; 345/161; 74/471 XY, 471 R; 463/36, 37, 38

[56] References Cited

U.S. PATENT DOCUMENTS

| | | | |
|---|---|---|---|
| 4,124,787 | 11/1978 | Aamoth et al. | 20/6 A |
| 4,249,057 | 2/1981 | Schlegel et al. | 200/296 |
| 4,291,201 | 9/1981 | Johnson et al. | 179/90 K |
| 4,506,118 | 3/1985 | Mollman | 200/1 R |
| 4,590,339 | 5/1986 | Scott-Jackson et al. | 200/6 A |
| 4,724,286 | 2/1988 | Cummins | 200/4 |
| 4,760,218 | 7/1988 | Gutman | 200/5 R |
| 4,786,768 | 11/1988 | Langewis et al. | 200/6 A |
| 4,874,224 | 10/1989 | Gutman et al. | 350/174 |
| 4,982,673 | 1/1991 | Kojima | 112/112 |
| 5,034,574 | 7/1991 | Martovitz | 200/6 A |
| 5,041,703 | 8/1991 | Roswold | 200/5 R |
| 5,043,709 | 8/1991 | Kim | 340/709 |
| 5,065,146 | 11/1991 | Garrett | 340/709 |
| 5,068,498 | 11/1991 | Engel | 200/6 A |
| 5,107,085 | 4/1992 | Roswold | 200/531 |
| 5,164,554 | 11/1992 | Ikunami | 200/5 E |
| 5,476,261 | 12/1995 | Hultstrand | 273/148 B |
| 5,494,445 | 2/1996 | Sekiguchi et al. | 434/365 |
| 5,508,479 | 4/1996 | Schooley | 200/5 R |
| 5,523,531 | 6/1996 | Ozaki | 200/5 R |
| 5,579,900 | 12/1996 | Pryor et al. | 200/331 |
| 5,604,483 | 2/1997 | Giangardella | 340/565 |
| 5,675,359 | 10/1997 | Anderson | 345/161 |
| 5,691,517 | 11/1997 | Yamamoto et al. | 200/6 A |
| 5,695,346 | 12/1997 | Sekiguchi et al. | 434/365 |
| 5,710,398 | 1/1998 | Hassler et al. | 200/5 A |
| 5,738,352 | 4/1998 | Ohkubo et al. | 273/148 B |
| 5,823,057 | 10/1998 | Hsien | 74/471 X |

*Primary Examiner*—Michael Friedhofer
*Attorney, Agent, or Firm*—Joseph S. Tripoli; Frederick A. Wein

[57] ABSTRACT

A button assembly has at least one button that can selectively actuate one or more microswitches mounted to a printed circuit board in response to a biasing force. The at least one button is coupled to a plate comprising a loading member. The loading member is in contact with a housing. The housing has a plurality of latches which engage the printed circuit board, holding the button assembly together.

23 Claims, 8 Drawing Sheets

BUTTON ASSEMBLY

BACKGROUND OF THE DISCLOSURE

1. Field of Invention

The present invention relates generally to a pushbutton assembly. More specifically, the present invention relates to a pushbutton assembly having a plate having a least one loading member that loads the assembly to prevent disengagement of a plurality of latches which hold the assembly together.

2. Description of the Background Art

Assemblies for selectively actuating switch closures in response to a manual movement of a member, such as multifunction button assemblies, have seen increasing utility and are often found in such devices as computer interfaces, joysticks, automotive mirror controls and the like. One application for multifunction button assemblies is in telecommunication devices such as televisions and associated peripherals (control boxes, remotes, video players and the like). Multifunction buttons incorporated into these devices allow a user to select responses to menu prompts in a quick and efficient manner, using a minimal amount of user interfaces.

Multifunction button assemblies typically comprise three basic elements, button or joystick actuator for interfacing with the user, a motion enabling means for returning the actuator to an unbiased position, and a printed circuit board containing microswitches and the like. One issue common to these assemblies is the positional accuracy between the actuator and the microswitches. Undesirable translational motion in the motion enabling means can result in the actuator missing the corresponding switch, or becoming "hung-up", i.e., stuck, upon the switch or other surrounding structure. Additionally, staking, heat staking, pressing, sonic welding and the like methods typically used for fastening the printed circuit board to the multifunction button assembly can often apply forces (and heat) that can overcome and defeat positioning devices intended to either align the actuators with the microswitches, or prevent the assembly from maintaining the printed circuit board at a predetermined distance form the actuator. Both of these positional defects can result in catastrophic failure of the multifunction button assembly. Other types of assembly methods which are not prone to defeating positional devices such as screws and rivets require additional components and consequently more assembly steps to complete.

Therefore, there is a need in the art for a multifunction button assembly that maintains a printed circuit board in good positional accuracy with relation to the associated actuators. Additionally, such multifunction button assemblies should have a minimum number of components, thus facilitating manufacturing efficiency and minimizing material cost.

SUMMARY OF INVENTION

The disadvantages associated with the prior art are overcome by the present invention of a button assembly. The button assembly comprises a housing, a plate, at least one button and a printed circuit board disposed at a predetermined distance from the plate. The housing has a retention means that retains the plate between the housing and the printed circuit board. The plate has at least one loading means in impinging against the housing that generates a force that keeps the retention means engaged with the printed circuit boards. The at least one button is coupled to the plate, partially protruding through the housing, and can selectively bias at least one switch mounted to the printed circuit board.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical element that are common to the figures.

DETAIL DESCRIPTION OF INVENTION

Figure 1:
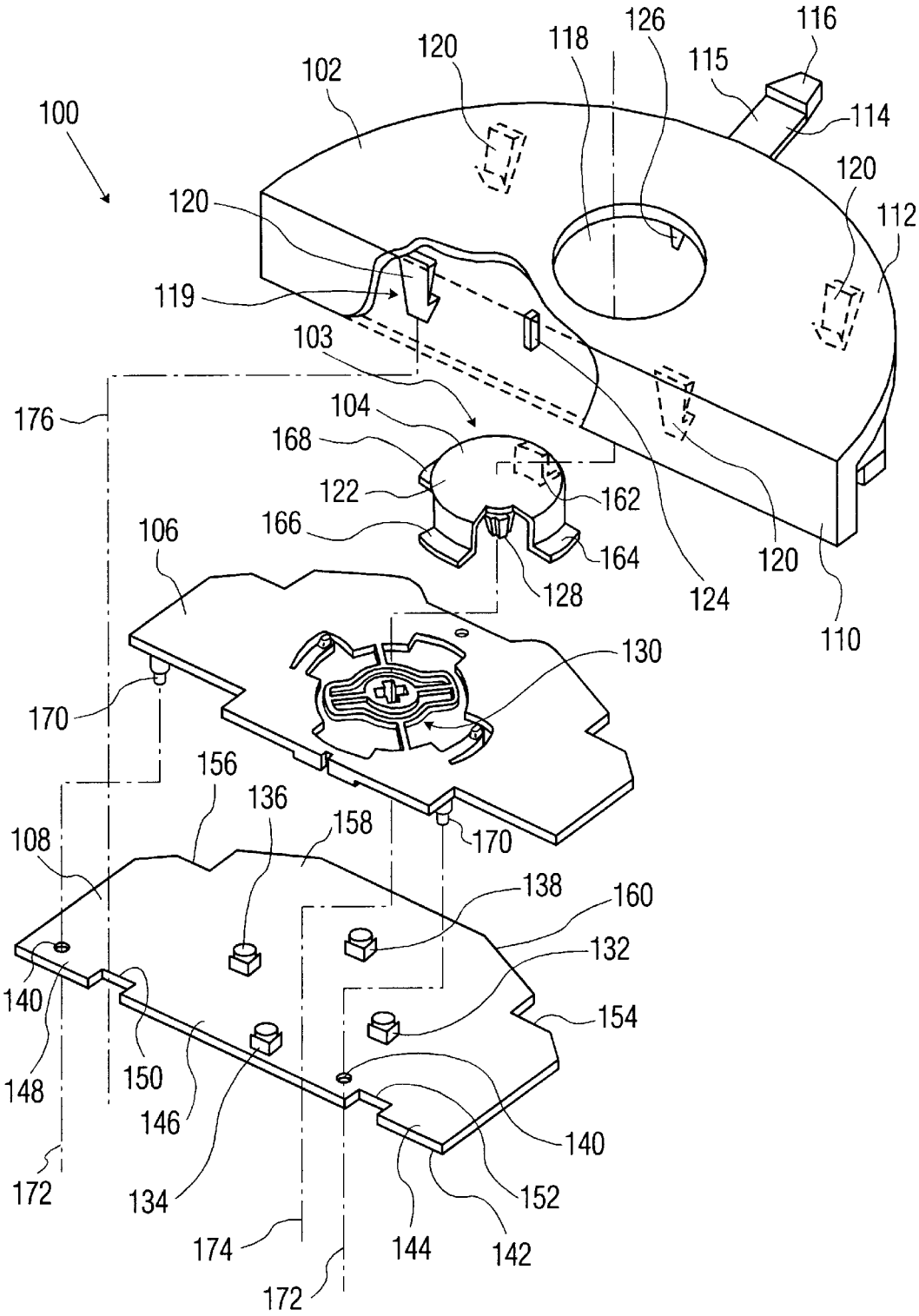
FIG. 1 depicts an exploded isometric view of a button assembly of the present invention.

FIG. 1 depicts a switch assembly 100 comprising a housing 102, a plate 106, at least one button 103 and a printed circuit board 108. The plate 106 is disposed between the housing 102 and printed circuit board 108. The housing 102 has a plurality of retention means 119 that engage the printed circuit board 108 and hold the switch assembly 100 together.

Figure 2:
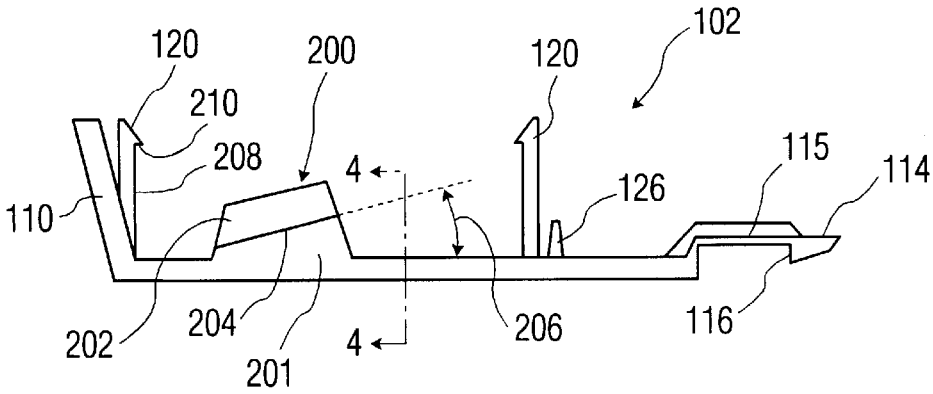
FIG. 2 depicts an elevation of a housing of the button assembly of FIG. 1.
Figure 3:
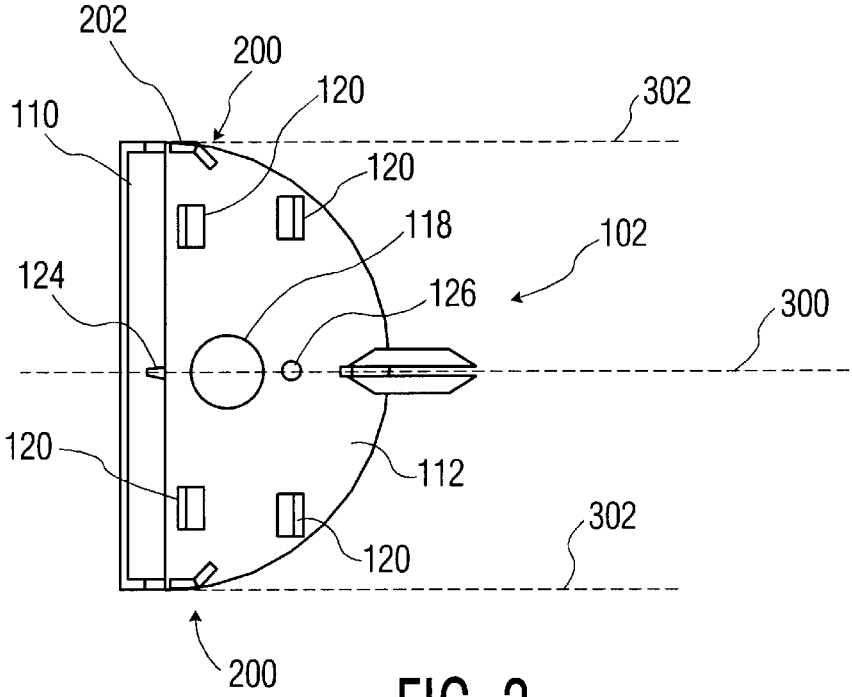
FIG. 3 depicts a plan view of the housing of the button assembly of FIG. 1.
Figure 4:
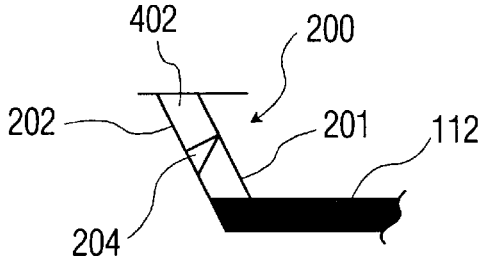
FIG. 4. depicts an elevation of the assembly guide of FIG. 2 taken along section line 4—4.

The housing 102 is depicted in greater detail in FIG. 2 and FIG. 3. The reader is encouraged to refer simultaneously to FIG. 1, FIG. 2 and FIG. 3 for the best understanding of the housing 102.

The housing 102 is preferably fabricated from a moldable plastic material. The housing 102 has a first surface 110 that angularly transitions into a second surface 112. The retention means 119, a tab 124, a pin 126 and a pair of assembly guides 200 protrude from the second surface 110. The retention means 119 is preferably a plurality of latches 120 (e.g., four). Each latch 120 comprises a flexible member 208 and a catch 210. The latches 120 are illustratively arranged in a rectangular array about an aperture 118 that is generally centered in the second surface 112. Optionally, other retention means 119 may be used, such as post and screws, heat staking, sonic welding, push connectors, rivets and the like. One skilled in the art will also appreciate that the housing 102 need only be held in a predetermined position relative to the plate 106 and printed circuit board 108. As such, other structures may be utilized to maintain this orientation.

The aperture 118, tab 124 and pin 126 are located along a centerline 300 of the housing 102. The aperture 118 is disposed between the tab 124 and the pin 126. An axial centerline 174 passes through the center of the aperture 118, intersecting the centerline 300. The tab 124 is connected to the first surface 110 and the second surface 112. The tab 124 and pin 126 are utilized to position the plate 106 in relation to the housing 102. Thus, one skilled in the art will be able to devise alternate geometry's and locations for the tab 124 and pin 126 that will provide the same positional relationship.

The assembly latch 114 extends from the housing 102 along the centerline 300 opposite the first surface 112. The assembly latch 114 comprises a flexible member 115 and a catch 116.

Each of the two assembly guides 200 that are positioned in two locations mirrored about the centerline 300 comprise a stanchion 201 that couples an alignment surface 202 and a guide surface 402 to the second surface 112 of the housing 102. The orientation of the alignment surfaces 202 defines imaginary lines 302 that are substantially parallel to the centerline 300. The guide surface 402 is orientated as to form an acute angle with the imaginary line 302 as depicted by arrow 304. The alignment surface 202 and the guide surface 402 share a lip 204 that is at an acute angle in regards to the second surface 112, as depicted by arrow 206. The lip 204 is positioned on the exterior side of the assembly guide 200.

The assembly latch 114 and assembly guide 200 allow the button assembly 100 to be easily installed within an enclosure, such as a television, television remote, cable control box, and the like (not shown). The catch 116 of the assembly latch 114 engages a surface in the enclosure, retaining the button assembly 100 in a position preferably having the first surface 110 flush with the exterior of the enclosure. The assembly guide 200 utilizes the guide surface 402 to roughly align the button assembly 100 to the enclosure, then the alignment surface 202, in conjunction with the lip 204, interfaces with a mating surface within the enclosure, and locates the button assembly 100 in an advantageous position relative to the enclosure.

Figure 5:
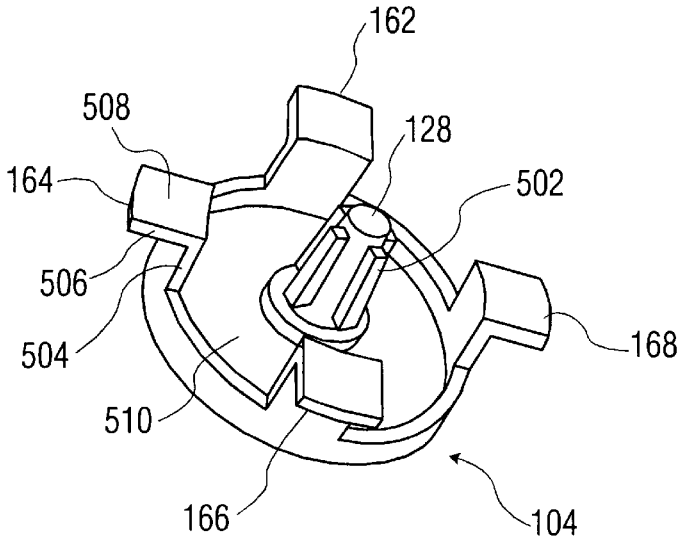
FIG. 5 depicts a perspective view of a selector button of the button assembly of FIG. 1.

In one embodiment, a selector button 104, detailed in FIG. 5, comprises the at least one button 103. The reader is encouraged to simultaneously refer to both FIG. 1 and FIG. 5 for the best understanding of the selector button 104. The reader should note that although the preferred embodiment utilizes a selector button 104 that functions as a multifunction selector (i.e., the button can selectively actuate more than one switch) a single action button, such as a button described in a second embodiment discussed below, may be readily substituted.

The selector button 104 is preferably fabricated from a moldable plastic or elastomer (e.g., polycarbonate). The selector button 104 has a first side 122 and a second side 510. A plurality of actuators (162, 164, 166, and 168) are disposed equidistant in polar array about the perimeter of the selector button 104 on the second side 510. Each actuator has a stanchion 504 that connects an outwardly turned pad 506 to the selector button 104. The pad 506 has a contact surface 508 that is substantially perpendicular to the centerline 174.

A boss 128 is centrally disposed on the second side 510 of the selector button 104. The boss 128 has a plurality of flutes 502 disposed axially along the circumference of the boss 128.

Figure 6:
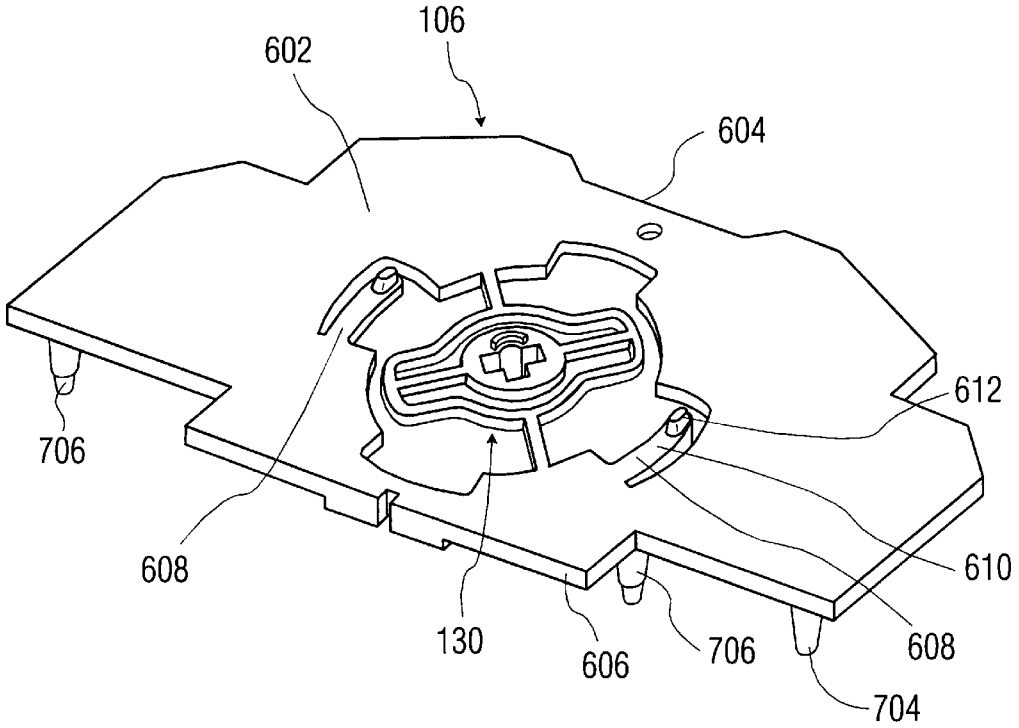
FIG. 6 is a perspective view depicting a first side of a plate of the button assembly of FIG. 1.
Figure 7:
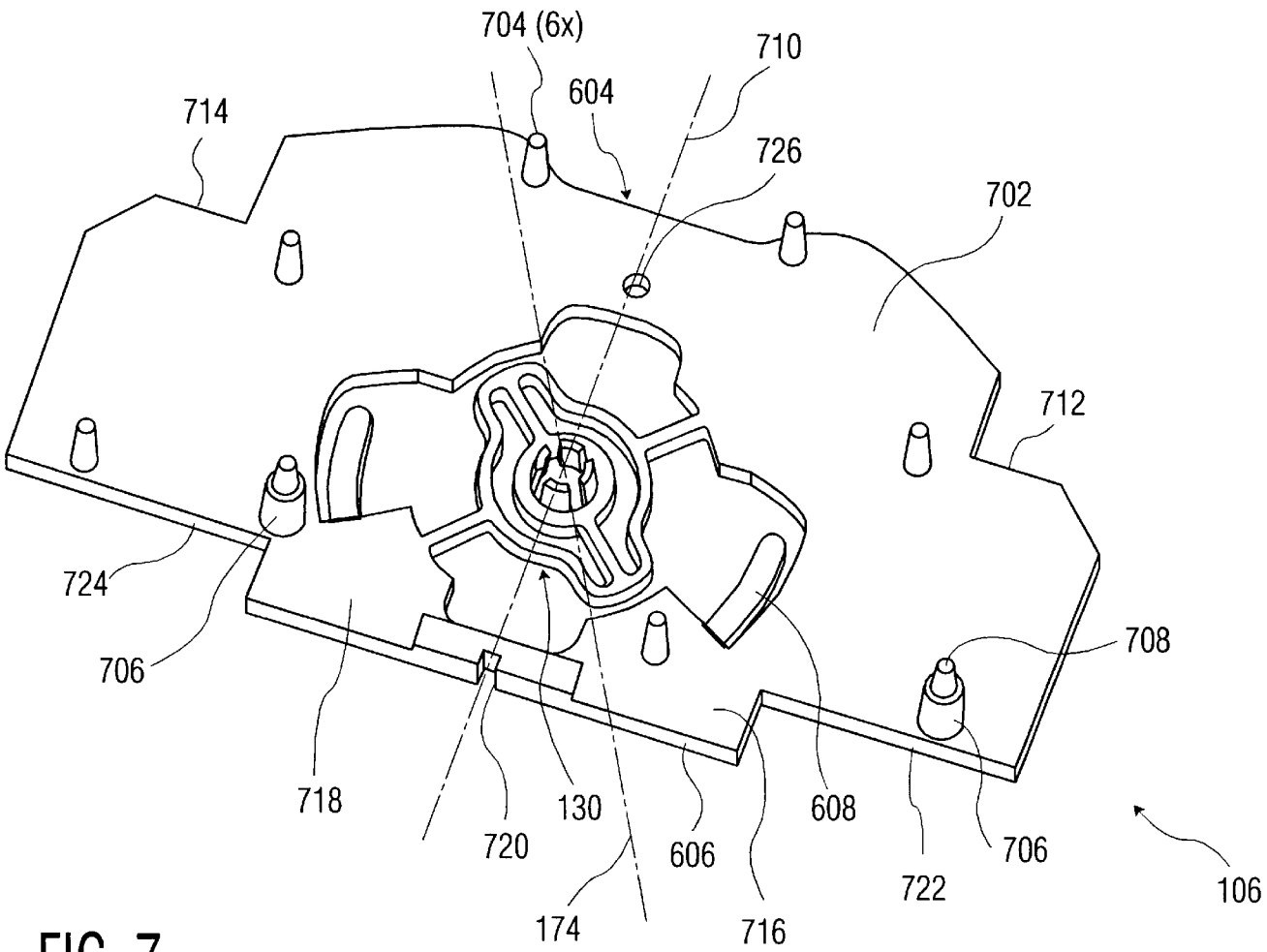
FIG. 7 is a perspective view depicting a second side of the plate of FIG. 6.

The plate 106 is depicted in greater detail in FIG. 6 and FIG. 7. The reader is encouraged to refer simultaneously to FIG. 1, FIG. 6 and FIG. 7 for the best understanding of the plate 106.

The plate 106 has a first side 602 and a second side 702 that meet at a first edge 604 and a second edge 606. The plate 106 is preferably fabricated from a moldable elastomer or plastic. The material selection, as well as the cross-sectional areas of certain members discussed below should be selected to produce the desired feel during actuation and to provide acceptable service life. The inventors have determined found that the plate 106 molded from polycarbonate produces a "positive" feel during the actuation of the button assembly 100, while demonstrating good service life.

The plate 106 has a plurality of first standoffs 704, a plurality of second standoffs 706, and a least one loading member 608. The first standoffs 704 protrude from the plate 106 as to maintain the printed circuit board 108 at a predetermined distance from the plate 106. The second standoffs 706 assist in maintaining the printed circuit board 108 at the predetermined distance from the plate 106. Each of the second standoffs 706 has a pin 708 that mates with a corresponding hole 140 in the printed circuit board 108, thereby positioning the printed circuit board 108 in relation to the plate 106. The pins 708 and corresponding holes 140 may be readily located or replaced by other types of locating structures commonly known in the art.

A first tab 716 and a second tab 718 outwardly project from the second edge 606. A slot 720 centered along a centerline 710 is defined by the first tab 716 and the second tab 718. The centerline 710, which intersects the centerline 174, additionally passes through the gimbal assembly 130 and a hole 726 perforated in the plate 106. The slot 720 and hole 726 respectively mate the tab 124 and pin 126 of the housing 102, thereby positioning the plate 106 in relation to the housing 102. These locating means (i.e., the tab 124 and pin 126) may be placed in other locations to achieve similar results.

At least one loading member 608 comprises a flexible arm 610 that couples a contact member 612 to the plate 106. The contact member 612 extends above the surface of the first side 602. The height of the contact member 612 and the geometry of the cross section of the flexible arm 610 is selected to impart at least a minimum amount of loading upon the plate 106 when assembled as further described below. In the preferred embodiment, two loading members 608 are disposed symmetrically about of the gimbal assembly 130 (i.e., one on each side).

The gimbal 130 assembly is centrally disposed in the plate 106. Simultaneously referring to FIG. 1 and FIG. 8, the gimbal 130 has a first traverse member 832, a second traverse member 834, an outer ring 836 and an inner ring 838. The outer ring 836 is concentrically aligned with the inner ring 838 along the centerline 174. The first traverse member 832 couples the outer ring 836 to the plate 106 in two opposing locations. The second traverse member 834 couples the outer ring 836 to the inner ring 838 also in two opposing locations. The first traverse member 832 is preferably disposed in an orthogonal orientation with respect to the second traverse member 834. The first traverse member 832 and the outer ring 836 are configured to define a plurality of passages 840 between the outer ring 836 and the plate 106. The passages 158 allow the actuators 162 through 168 to pass through the plate 106 when the selector button 104 is connected to the gimbal 130 in the manner described below. The reader will appreciate that one skilled it the art will be able to devise a number of variations of the gimbal 130 which allow for the actuators (162, 164, 166 and 168) to pass through the plate 106 while remaining within the scope of the teachings described herein.

The first traverse member 832 defines a first axis of rotation 802. The cross-sectional area of the first traverse member 832, coupled with the material selection of the plate 106, allows for the first traverse member 832 to flex (i.e., twist) along the first axis 802 as to allow the outer ring 836 to rotate as indicated by arrow 804. The second traverse member 834 likewise defines a second axis of rotation 806. The reader should note that as the second traverse member 834, and thus the second axis 806 as well, remains in the plane defined by the outer ring 836. The cross-sectional area, coupled with the material selection of the plate 106 allows for the second traverse member 834 to flex, i.e., twist, along the second axis 806 as to allow the inner ring 838 to rotate in relating to the outer ring 836 as indicated by arrow 808. The combined rotation about axis 802 and 806 results in the inner ring 838 acquiring a pivoting motion with respect to the plate 106 about a pivot point 842 defined by the intersection of the first axis 802, the second axis 806 and the centerline 174. Thus, translational motion of the inner ring 838 with respect to the plate 106 is substantially prevented.

The inner ring 838 has a plurality of protruding fingers 844 disposed in a polar array about the inside diameter 846. The boss 128 passes through the inside diameter 846 such that the flutes 502 align between the plurality of protruding fingers 844, orientating the selector button 104 with the plate 106. The boss 128 and protruding fingers 844 are configured as to create an interference fit, thus retaining the selector button 104 in the gimbal assembly 130.

Referring back to FIG. 1, the printed circuit board 108 contains at least one switch. The at least one switch preferably comprises a plurality of switches (i.e., four microswitches, 132 through 138, respectively). Although the preferred number of microswitches is four, one skilled in the art may readily modify the selector button 104 and gimbal 130 to accommodate additional (or fewer) microswitches. The microswitches 132 through 138 are arranged in a polar array about the centerline 174. A plurality of locating holes 140 mate with the pins 708, and maintain the printed circuit board 108 in an orientation such that the microswitches 148 through 154 remain aligned with the corresponding actuators 162 through 168 of the selector button 104.

The printed circuit board 108 has a first edge 142 and an opposing second edge 160. The first edge 142 has a first, second and third projecting tab, 144, 146 and 148, respectively. A first notch 152 is defined between projecting tabs 144 and 146, while a second notch 150 is defined between projecting tabs 146 and 148. The second edge 160 has a projecting center area 158 that separates a third notch 156 and a fourth notch 154. The notches 150, 152, 156, and 158 are located so that the latches 120 of the housing 176 engage and retain the printed circuit board 108 when assembled as depicted by the imaginary line 176.

The button assembly 100 is put together by first coupling the selector button 104 to the gimbal assembly 130 of the plate 106. The plate 106 is set into the housing 102 such that the selector button 104 partially protrudes through the aperture 118 of the housing 102 and the tab 124 and pin 128 mate with the corresponding slot 720 and hole 726 of the plate 106. The printed circuit board 108 is then disposed proximate the plate 106 by aligning the pins 708 to respectively mate with the holes 140 (along imaginary lines 172), and snapping the catch 210 of the latches 120 protruding from the housing 120 in the respective lands (150 through 156) of the printed circuit board 108 (for example, as depicted in one of four locations by imaginary line 176). The first and second standoffs (704 and 706) maintain the printed circuit board 104 at the predetermined distance from the plate 106. The contact members 612 of the loading members 608 impinge against the second surface 112 of the housing 102, causing the flexible arm 610 to deflect and exert a force that causes the catch 210 of the latches 120 to remain engaged with the printed circuit board 108, thus preventing unwanted component movement and possible disengagement.

Figure 8:
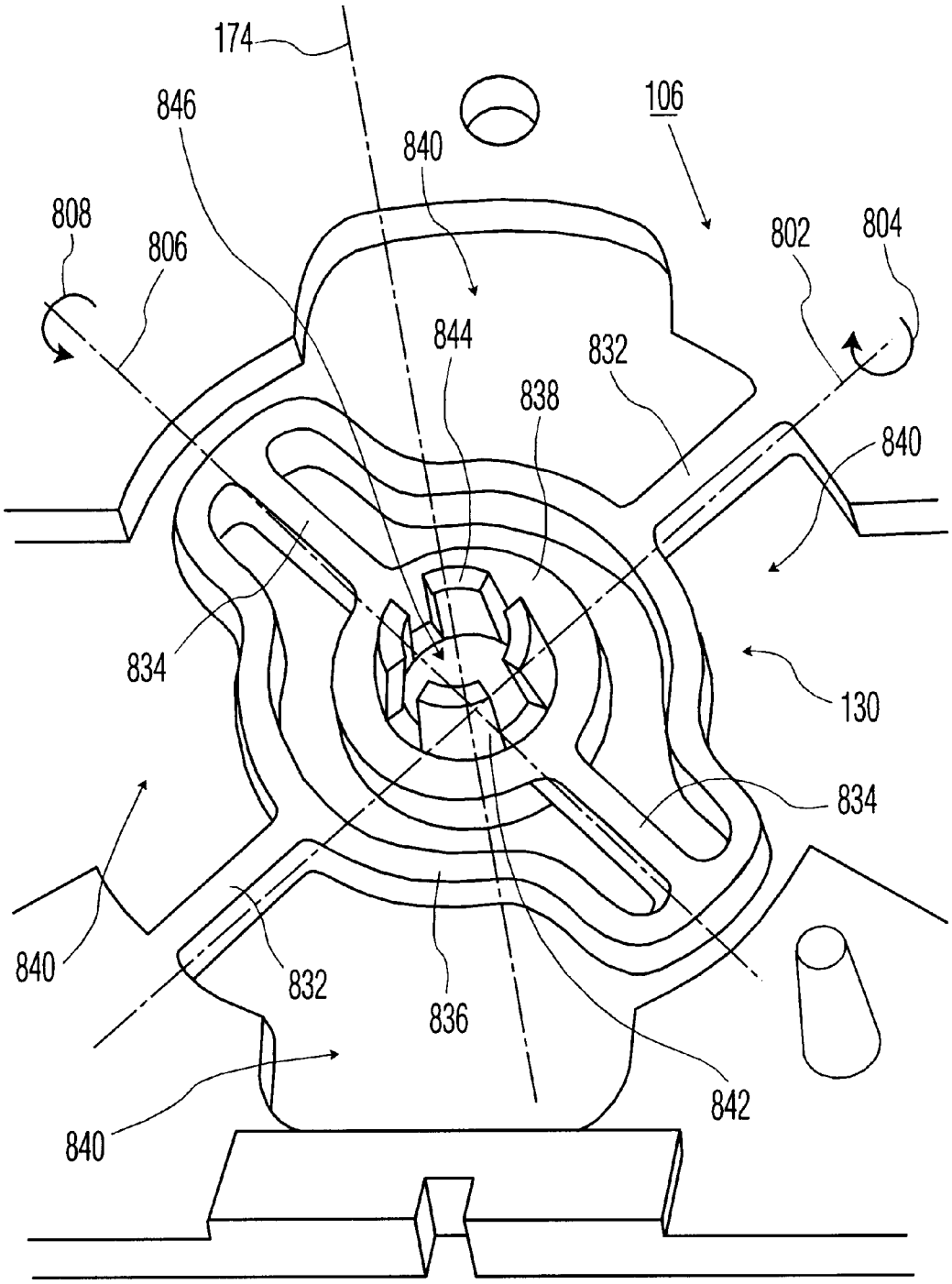
FIG. 8 is a detailed view of a gimbal assembly of the plate of FIG. 7.
Figure 9:
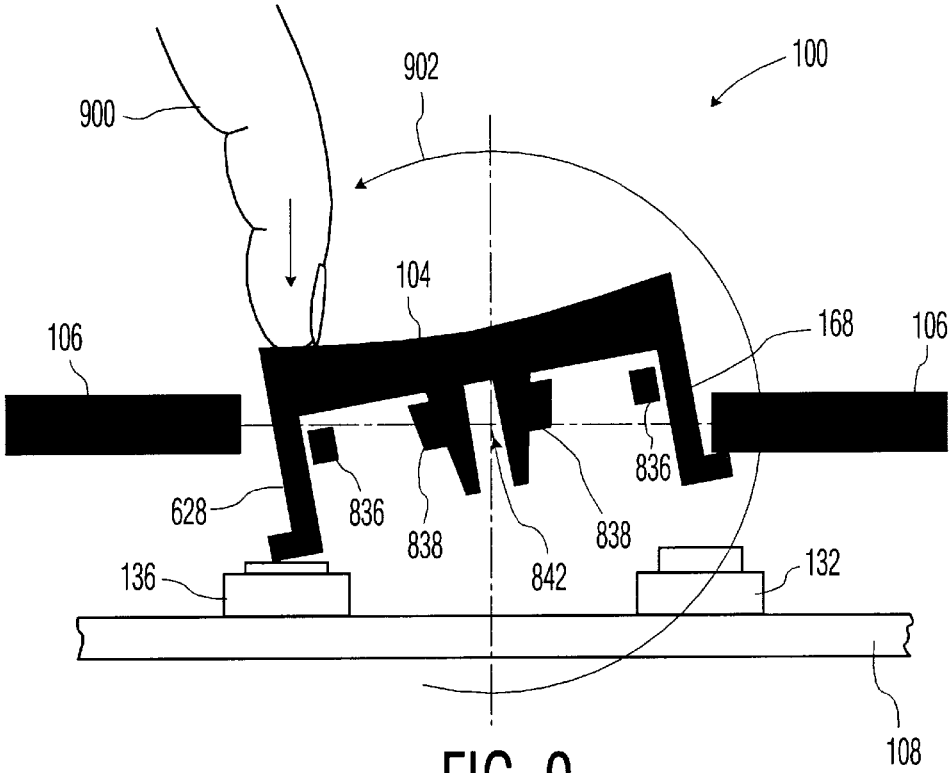
FIG. 9 is a cross sectional view of the button assembly of FIG. 1 with a biasing force applied to the selector button.
Figure 10:
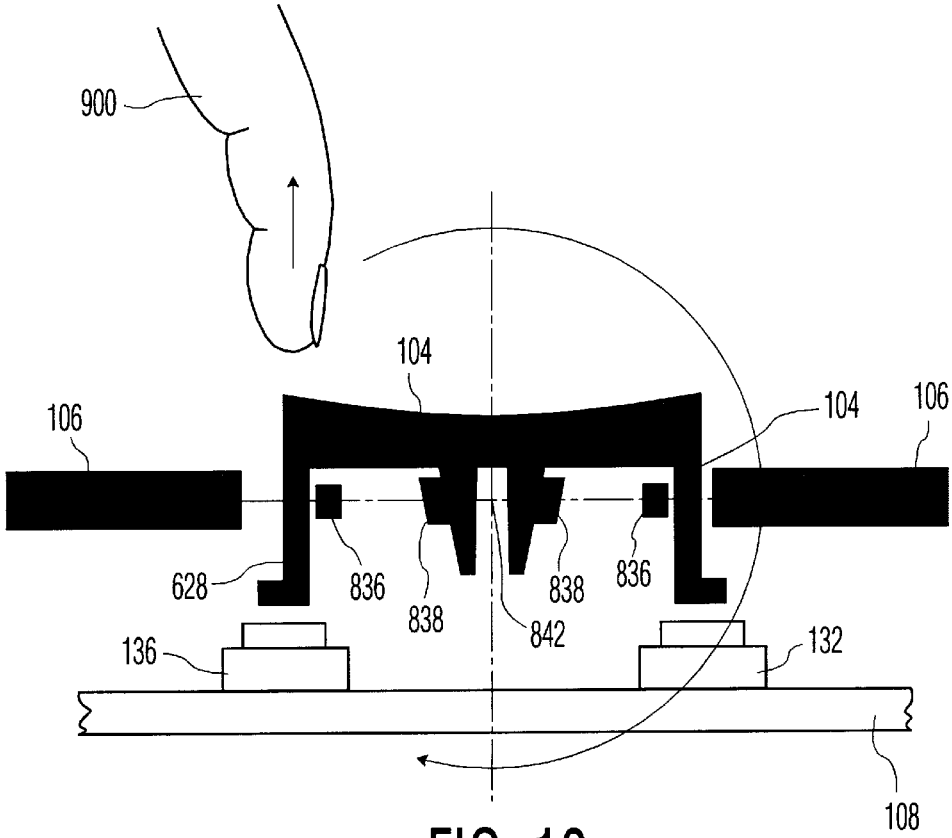
FIG. 10 is a cross sectional view of the button assembly of FIG. 1 with the biasing force removed.

The operation of the button assembly 100 is best understood while referring to FIG. 9 and FIG. 10. The button assembly 100 allows the user to selectively actuate a desired switch on the printed circuit board 108, for example, to navigate through a selection of menu choices in order to obtain a desired result. For example, the selector button 104 is manipulated by a biasing force 900, i.e., by depressing a selected area of the selector button 104. The selector button 104 rotates as depicted by arrow 902 about the pivot point 842 in response to the force 900, causing the actuator 168 to depress, i.e., actuate, the microswitch 136 attached to the printed circuit board 108. Upon removal of the force 900, the resiliency of the traverse members (832 and 834 as seen in FIG. 8) causes the selector button 104 to return to an unbiased position as indicted by arrow 1002, de-actuating the microswitch 136. The selector button 104 may be biased as to actuate any singular microswitch by applying the force 900 to the selector button 104 above the desired microswitch. Alternately, any adjacent pair of microswitches (i.e., 132 and 134, 134 and 136, 136 and 138, and, 138 and 132) may be biased by applying the force 900 to the selector button 104 between the desired microswitches.

Figure 11:
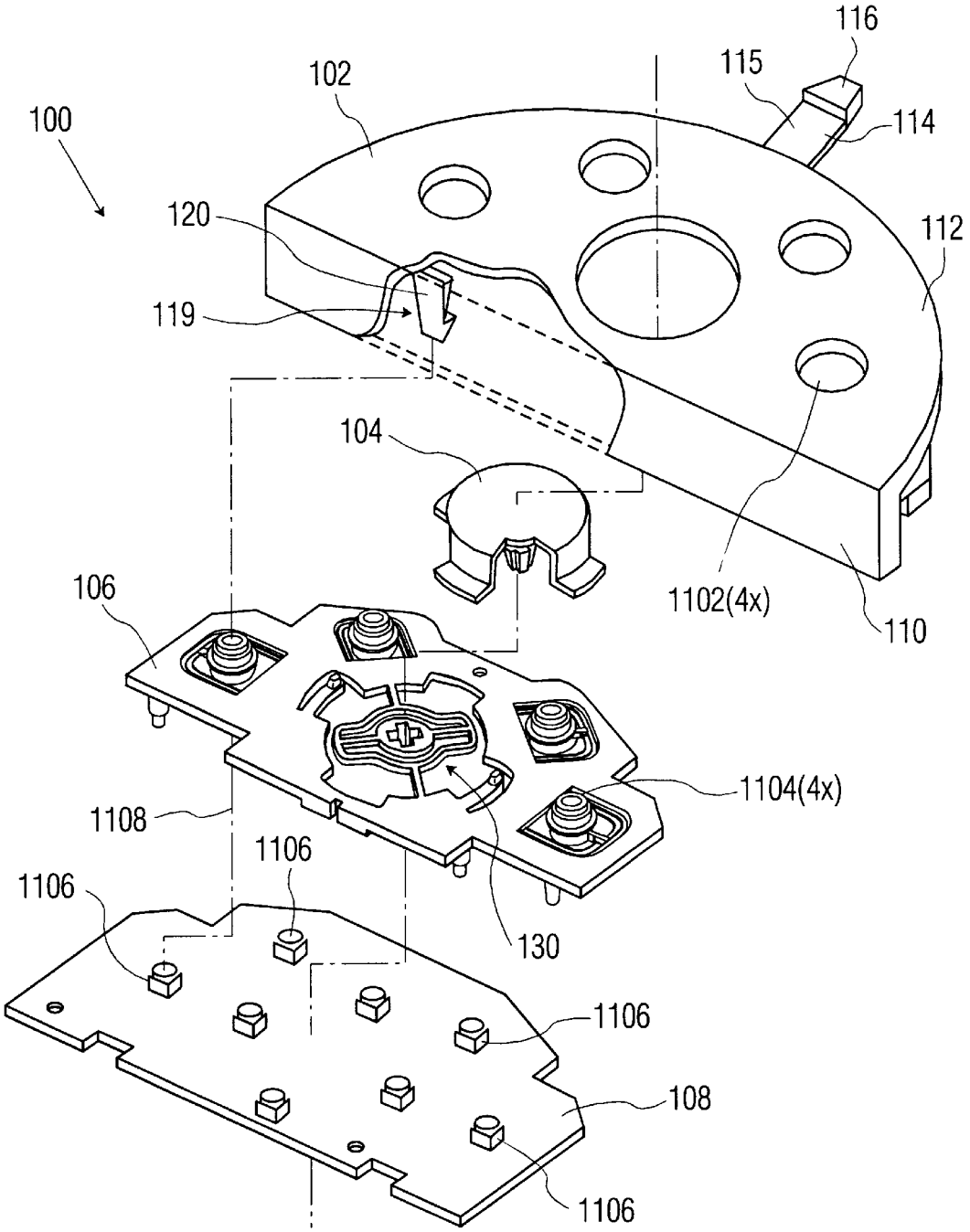
FIG. 11 is an exploded isometric view of a second embodiment of the button assembly; and, FIG. 12 is an exploded view of a plate of the button assembly of FIG. 11.
Figure 12:
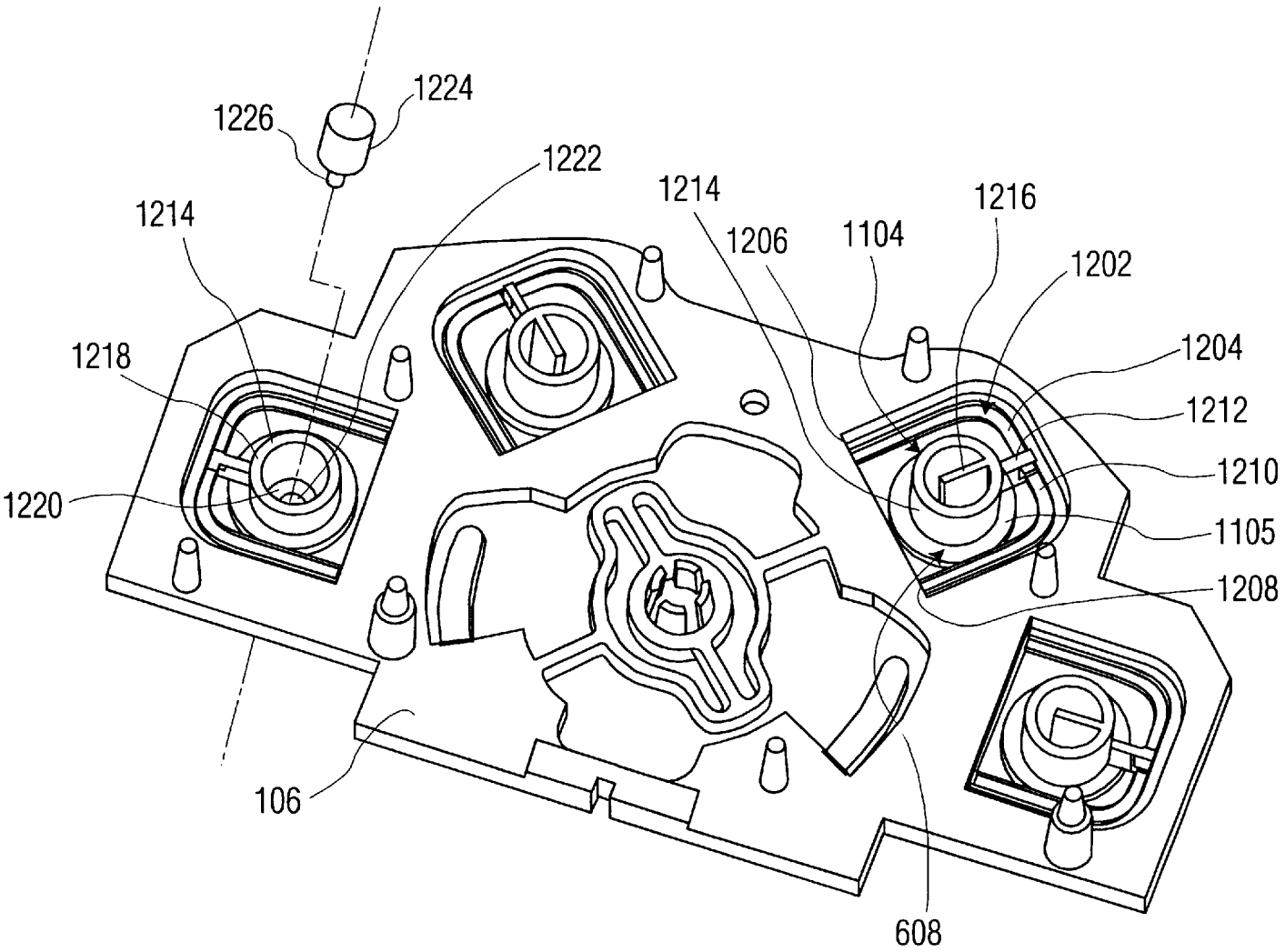

A second embodiment of the button assembly 100 is depicted in FIG. 11 and FIG. 12. Specifically, the second embodiment comprises a housing 102, a plate 106, a selector button 104 and a printed circuit board 108. The plate 106 is disposed between the housing 102 and printed circuit board 108. The housing 102 has a plurality of retaining means 119 that engage the printed circuit board 108 and hold the switch assembly 100 together. Distinguishing the second embodiment from the first embodiment are a plurality of buttons 1104 (e.g., four) that surround the selector button 104. The buttons 1104 protrude though the housing 102 though a corresponding openings 1102. The buttons 1104 actuate corresponding microswitches 1106 on the printed circuit board 108 (along imaginary line 1108).

Each button 1104 is coupled to the plate 106 via a double cantilever hinge 1202. The hinge 1202 comprises a "U" shaped member 1204 having ends 1206 and 1208 that attach the hinge 1202 to the plate 106. The hinge center 1210 is coupled to cantilever member 1212 that is coupled to the button center 1214. The button center 1214 has a internal flange 1216 that actuates the respective microswitch when the button 1104 is subjected to a biasing force. Additionally, each button 1104 comprises a loading member 608, embodied as a circumferential flange 1105. The circumferential flange 1105 impinges against the second surface 112 of the housing 102, flexing the hinge 1202 and generating a force that causes the latch 120 to remain engaged with the printed circuit board 108.

An alternate embodiment of the button 1214 comprises a hollow body 1218 having a bottom 1220. A passage 1222 is centrally located in the bottom 1222. A translucent plug 1224, having a nub 1226, is inserted into the hollow body 1218 so that the nub 1226 fits the passage 1222. As such, a LED or similar device (not shown) on the printed circuit board 108 will illuminate the plug 1224, consequently making the illuminated nub 1226 be visible to the user.

As the embodiments that incorporate the teachings of the present invention have been shown and described in detail, those skilled in the art can readily devise many other varied embodiments that still incorporate these teachings without departing from the spirit of the invention.

What is claimed is:

1. Apparatus for actuating at least one switch comprising:

a housing having a retention means;

a plate disposed adjacent said housing, said plate having at least one loading means in contact with said housing;

at least one button coupled to said plate and partially protruding through said housing; and, a printed circuit board disposed at a predetermined distance from said plate, said printed circuit board coupled to said housing by said retention means, said printed circuit board having at least one microswitch that may be biased by said at least one button.

2. The apparatus of claim 1 wherein said at least one button further comprises:

a selector button having a plurality of actuators.

3. The apparatus of claim 2 wherein said printed circuit board further comprises:

four microswitches selectively actuated by said selector button.

4. The apparatus of claim 1 wherein the retention means further comprises a plurality of latches, each of said plurality of latches having a catch that engages said printed circuit board.

5. The apparatus of claim 1 wherein the plate further comprises:

a gimbal assembly.

6. The apparatus of claim 5 wherein the gimbal further comprises:

a first traverse member coupled to said plate;

an outer ring coupled to said first traverse member;

an inner ring concentrically aligned with said outer ring, said inner ring having a plurality of fingers, said at least one button retained to said gimbal by said fingers; and, a second traverse member coupled to said outer ring and said inner ring.

7. The apparatus of claim 6 wherein the second traverse member is orthogonally disposed to said first traverse member.

8. The apparatus of claim 7 further comprising:

said first traverse member, said outer ring and said plate defining a plurality of passages in said plate; said plurality of actuators passing respectively through said plurality of passages.

9. The apparatus of claim 1 wherein said at least one loading means is two loading members.

10. The apparatus of claim 9 wherein each of said loading member further comprises:

a contact member in contact with said housing;

a flexible arm coupling said contact member to said plate.

11. The apparatus of claim 1 wherein said selector button selectively singularly actuates one of said microswitches or selectively actuates an adjacent pair of said microswitches.

12. The apparatus of claim 1 wherein said plate is polycarbonate.

13. The apparatus of claim 1 further comprising:

at least one button comprises a selector button surrounded by a plurality of buttons.

14. The apparatus of claim 13 wherein said plurality of buttons is four buttons.

15. The apparatus of claim 13 wherein said plurality of buttons are coupled to said plate via a double cantilever hinge.

16. The apparatus of claim 1 wherein said plate further comprises:

a plurality of pins, each of said pins mating with a corresponding hole in said printed circuit board; and, a first and second protruding tab defining a slot, said slot mating with a tab protruding from said housing.

17. Apparatus for actuating at least one switch comprising:

a selector button having a boss and a plurality of protruding actuators;

a housing having an aperture, and a plurality of latches, said selector button partially disposed in said aperture;

a plate having a gimbal, a plurality of standoffs, at least one loading member, said gimbal connected to said selector button, said at least one loading member contacting said housing; and a printed circuit board, disposed against said plurality of standoffs of said plate, plurality of switches aligned with said plurality of protruding actuators wherein said selector button may be biased to selectively cause at least one of said plurality of actuators to actuate at least one of said switches.

18. The apparatus of claim 17 wherein said selector button selectively singularly actuates one of said microswitches or selectively actuates an adjacent pair of said microswitches.

19. The apparatus of claim 17 wherein said plate further comprises:

a plurality of buttons disposed around said gimbal.

20. The apparatus of claim 19 wherein said printed circuit board further comprises:

a second plurality of microswitches, wherein said plurality of buttons may be biased to respectively actuate a corresponding microswitch of said second plurality of switches.

21. The apparatus of claim 19 wherein said plurality of buttons is four.

22. The apparatus of claim 17 wherein said at least one loading member further comprises:

a contact member in contact with said housing;

a flexible arm coupling said contact member to said plate.

23. The apparatus of claim 17 wherein said plate further comprises:

a plurality of pins, each of said pins mating with a corresponding hole in said printed circuit board; and, a first and second protruding tab defining a slot, said slot mating with a tab protruding from said housing.

* * * * *